US005448252A

United States Patent [19]

Ali et al.

[11] Patent Number: 5,448,252

[45] Date of Patent: Sep. 5, 1995

[54] WIDE BANDWIDTH MICROSTRIP PATCH ANTENNA

[75] Inventors: Azar S. Ali, Colorado Springs; Kuldip C. Gupta, Boulder, both of Colo.

[73] Assignee: The United States of America as Represented by the Secretary of the Air Force, Washington, D.C.

[21] Appl. No.: 215,794

[22] Filed: Mar. 15, 1994

[51] Int. Cl.[6] ..... H01Q 1/38

[52] U.S. Cl. ..... 343/700 MS; 343/785; 333/237; /

[58] Field of Search ..... 343/700 MS, 785, 846; 333/237; H01G 1/38

[56] References Cited

U.S. PATENT DOCUMENTS

| | | | |
|---|---|---|---|
| 4,777,490 | 10/1988 | Sharma et al. | 343/700 MS |
| 4,924,236 | 5/1990 | Schuss et al. | 343/700 MS |
| 5,115,217 | 5/1992 | McGrath et al. | 333/246 |
| 5,124,713 | 6/1992 | Mayes et al. | 343/700 MS |
| 5,155,493 | 10/1992 | Thursby et al. | 343/700 MS |
| 5,173,711 | 12/1992 | Takeuchi et al. | 343/700 MS |
| 5,210,541 | 5/1993 | Hall et al. | 343/700 MS |
| 5,241,321 | 8/1993 | Tsao | 343/700 MS |

*Primary Examiner*—Donald Hajec
*Assistant Examiner*—Tan Ho
*Attorney, Agent, or Firm*—Stanton E. Collier; Jacob N. Erlich

[57] ABSTRACT

An improved microstrip patch antenna has a pair, for example, of dielectric overlay strips attached along the radiating edges of the patch where the patch is rectangular. By optimizing dimensions parameters and materials, the bandwidth of the patch is increased substantially as well as the amount of radiated energy.

10 Claims, 4 Drawing Sheets

WIDE BANDWIDTH MICROSTRIP PATCH ANTENNA

STATEMENT OF GOVERNMENT INTEREST

The invention described herein may be manufactured and used by or for the Government for governmental purposes without the payment of any royalty thereon.

BACKGROUND OF THE INVENTION

The present invention relates to antennas, and, in particular, relates to microstrip patch antennas.

Designs for currently available printed antennas (electromagnetic waves radiating structures) make use of thin films of good conductors such as copper and gold. The thin film conductors are deposited, printed, or etched onto thin, low loss dielectric substrates which are usually backed by another good conductor. The thickness of the good conductor on top of the dielectric substrate is several times the conductor's skin depth. This is done to minimize the conductor loss. The usual thickness range from 0.5 to 2.0 mils (12 to 50 microns). A typical microstrip patch antenna configuration is shown in FIG. 1.

These types of antennas have been studied extensively. A recent publication, Handbook of Microstrip Antennas, vol. 1 and 2, edited by J. R. James and P. S. Hall, Perigrinus Press, UK, 1989, is a comprehensive overview of the current state-of-the-art and is incorporated by reference. Various versions of the configuration shown in FIG. 1 are used in practice. The most commonly-used shapes include rectangles, circles, and triangles. The most common methods of exciting the patches are via a vertical probe which is fed through the ground plane, or via a microstrip line on the top surface of the dielectric substrate.

These microstrip patch antennas are usually used as elements of array antennas. The most common applications for these antennas are on aircraft, satellites, missiles, telemetry systems, battlefield surveillance systems, domestic DBS receivers, reflector feeds, and convert antennas.

The disadvantage of currently available microstrip patch antennas is their narrow radiation bandwidth. Typical bandwidth values range between 1 and 4%. The bandwidth is inversely related to the Q-factor of the patch's equivalent cavity. Several approaches have been made to increase the bandwidth of these patch antennas but each attempt introduces some new disadvantage. For example, increasing the substrate height does increase the bandwidth but it also increases the excitation of surface waves and radiation from the feed lines, both undesirable side effects. Another approach utilizes multiple patches which are stacked vertically at different levels in the substrate. This approach increases fabrication difficulties and hence the cost of the antenna. Also, in both of the above approaches, the total thickness of the antenna is increased which reduces its utility in low profile operations.

SUMMARY OF THE INVENTION

The present invention substantially increases the bandwidth of microstrip patch antenna. Each microstrip patch antenna of the present invention comprises a metallic patch of conventional shape having a pair of dielectric overlay strips attached along the edges of the patch and onto the substrate.

Therefore, one object of the present invention is to provide an improved microstrip patch antenna.

Another object of the present invention is to provide an improved microstrip patch antenna having a substantially increased bandwidth.

Another object of the present invention is to provide an improved microstrip patch antenna being easily fabricated and having increased bandwidth.

These and many other objects and advantages of the present invention will be readily apparent to one skilled in the pertinent art from the following detailed description of a preferred embodiment of the invention and the related drawings.

DETAILED DESCRIPTION OF THE PREFERRED EMBODIMENT

Figure 1:
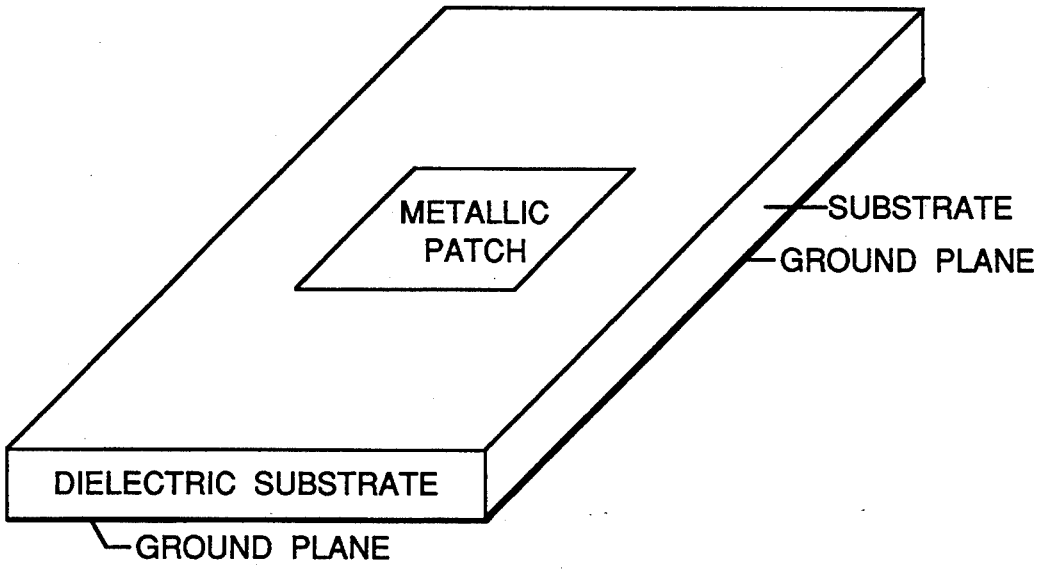
FIG. 1 PRIOR ART
FIG. 1 illustrates a conventional prior art microstrip patch antenna without feeds.
Figure 2:
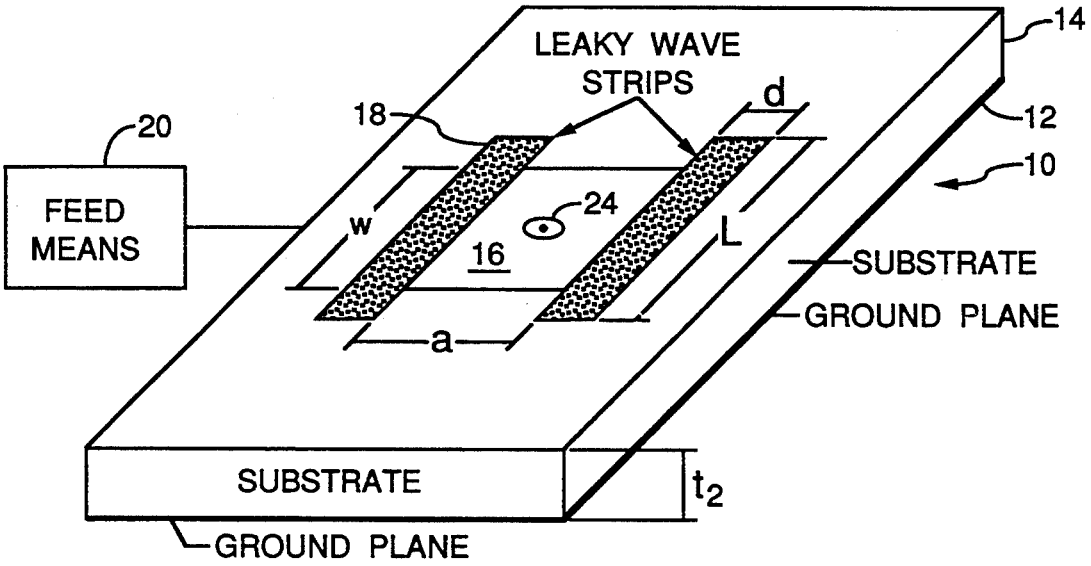
FIG. 2 illustrates by view the present invention.
Figure 3:
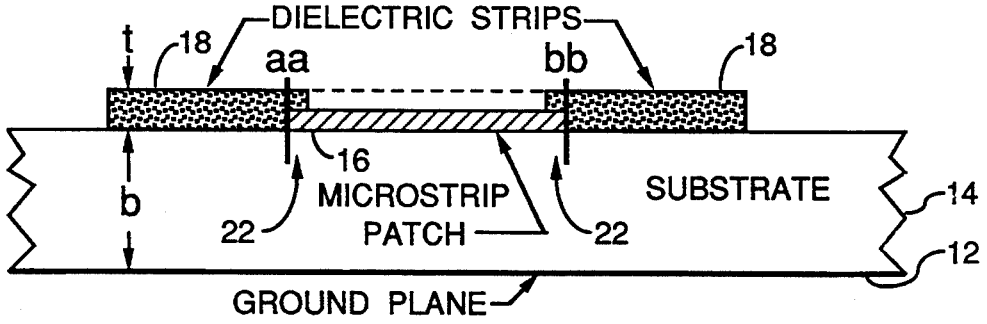
FIG. 3 illustrates by cross section the present invention shown by view in FIG. 2.

Referring to FIG. 2 and 3, an improved microstrip patch antenna element 10 is illustrated.

As seen therein, the microstrip patch antenna element 10 is composed of a ground plane 12, a substrate 14, a patch 16, a pair of leaky wave strips 18, and feed means 20.

The following U.S. Patents are incorporated by reference: U.S. Pat. Nos. 5,115,217; 5,124,713; 5,155,493; 5,173,711; 5,210,541; and 5,241,321. For example, U.S. Pat. No. 5,155,493 illustrates the conventional mounting of the patch antenna element on a curved surface, feeding of the patch antenna through the substrate, and a multi-layered antenna.

The present invention enhances the bandwidth of the conventional microstrip antenna by modifying the regions near the radiating edges 22, FIG. 3, by the placement thereabout of the leaky overlay wave strips 18 of another dielectric material.

The thickness, t, and the dielectric constant, , of the dielectric overlays strips 18 are selected such that the improved microstrip patch antenna 10 can propagate leaky electromagnetic waves. The leaky waves propagate along the substrate 14 but rapidly loose energy to the radiation field as they propagate away from the edges of the metallic patch 16.

The leakage rate (or attenuation constant) depends on the parameters of the substrate 14 and the dielectric overlay strips 18. Algorithms for computing the attenuation constant (leakage rate) and the characteristic impedance of the leaky wave region are disclosed below. Inclusion of these leaky wave regions increases the effective radiation conductance at the edges of the microstrip patch 16. For example, for a rectangular microstrip patch 16 of conventional design ( $_r$=2.2, $t_2=\frac{1}{8}$ inch, frequency=5 GHz, w=1 cm), the effective radiation conductance at the two radiating edges 22 is $0.956\times10^{-3}$ ℧. When the present invention is used with a dielectric overlay strip 18 which is 1/16 inch thick and $_r$=10, the effective radiation conductance increases to $0.994\times10^{-2}$ ℧. This change corresponds to a bandwidth (VSWR<2) improvement from 3.8% for the conventional patch to 33% for the present invention. Additional results based on several similar computations are summarized in Table I. It may be noted that an increase in the radiation conductance at the edges of the microstrip patch antenna.

TABLE 1

| Percent bandwidth of augumemnted microstrip patch at 5 GHz, W = 1 cm, b = ⅛ inch | | |
|---|---|---|
| Thickness (inch) $\epsilon_r$ | 6 | 10 |
| 1/16 | 18% | 33% |
| 1/32 | 12% | 16% |
| 1/64 | 9% | 10% |

Figure 4:
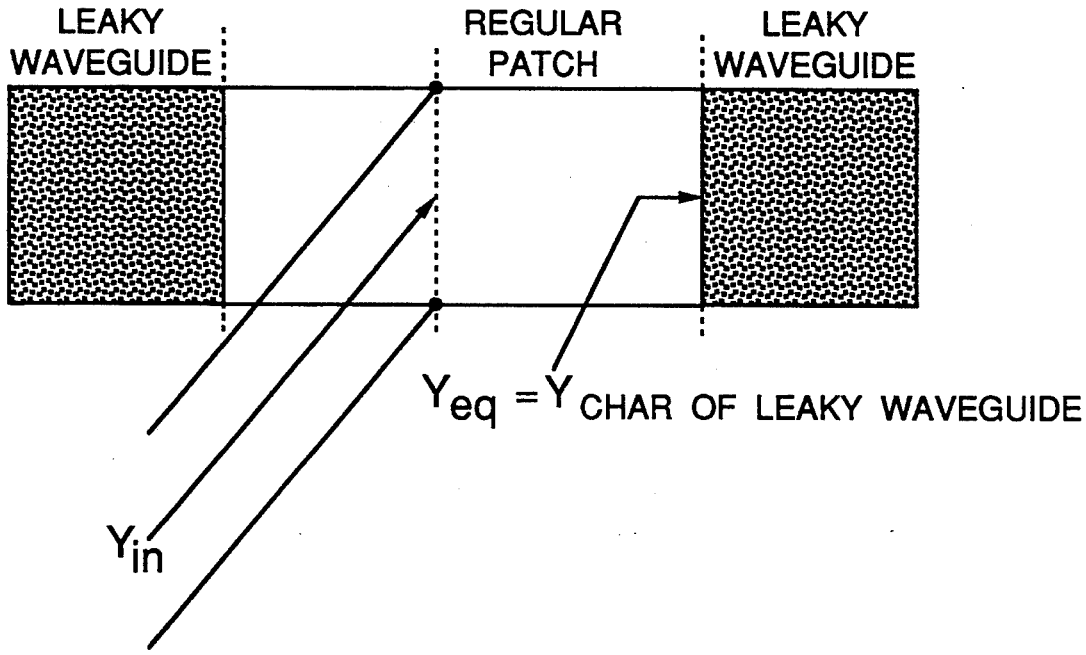
FIG. 4 illustrates a transmission line model of the present invention.

Details of the transmission line model, as applied to conventional microstrip patches, are available in the literature. See for example, *Microstrip Antenna Design*, by K. C. Gupta and A. Benalla, published by Artech House, Norwood, Mass., 1988 which is incorporated herein by reference. When the transmission line modeling approach is extended to the present invention disclosed here, the leaky wave regions are represented by sections of equivalent transmission lines. This is shown in FIG. 4. The characteristic impedance of these equivalent lines is a complex quantity (because of the leakage) and is calculated by the method given below.

Figure 5:
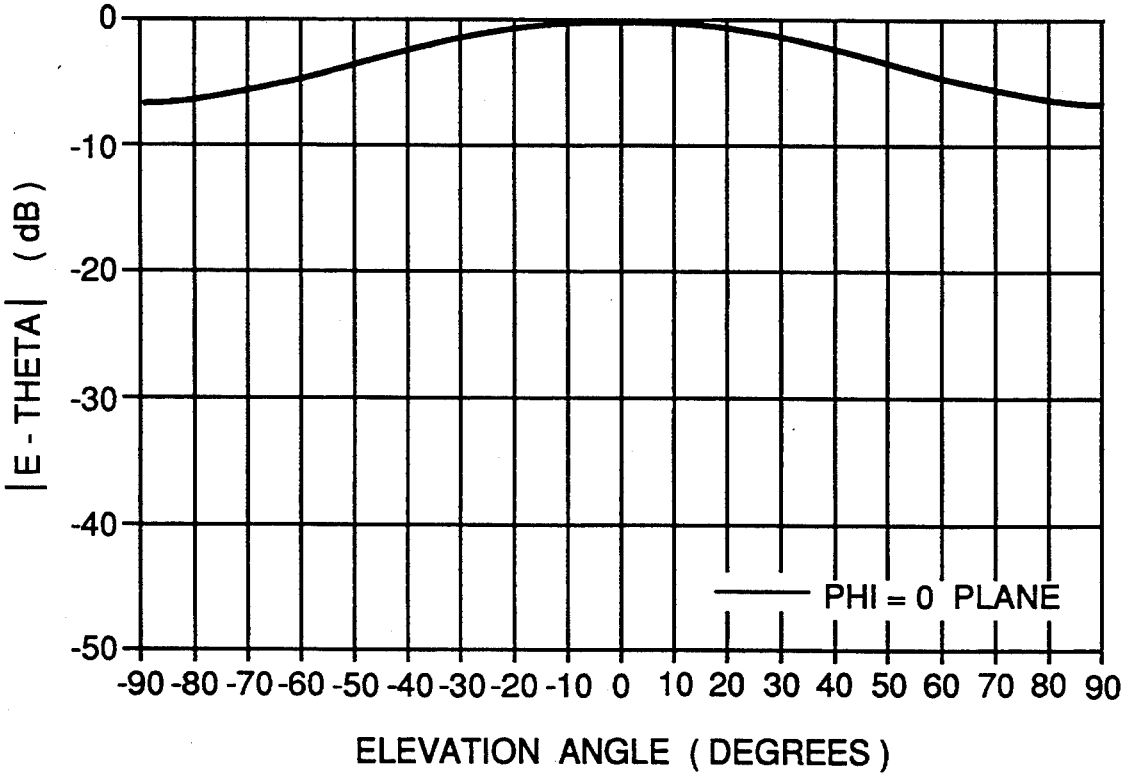
FIG. 5 illustrates the E-plane far-field radiation pattern of the present invention.
Figure 6:
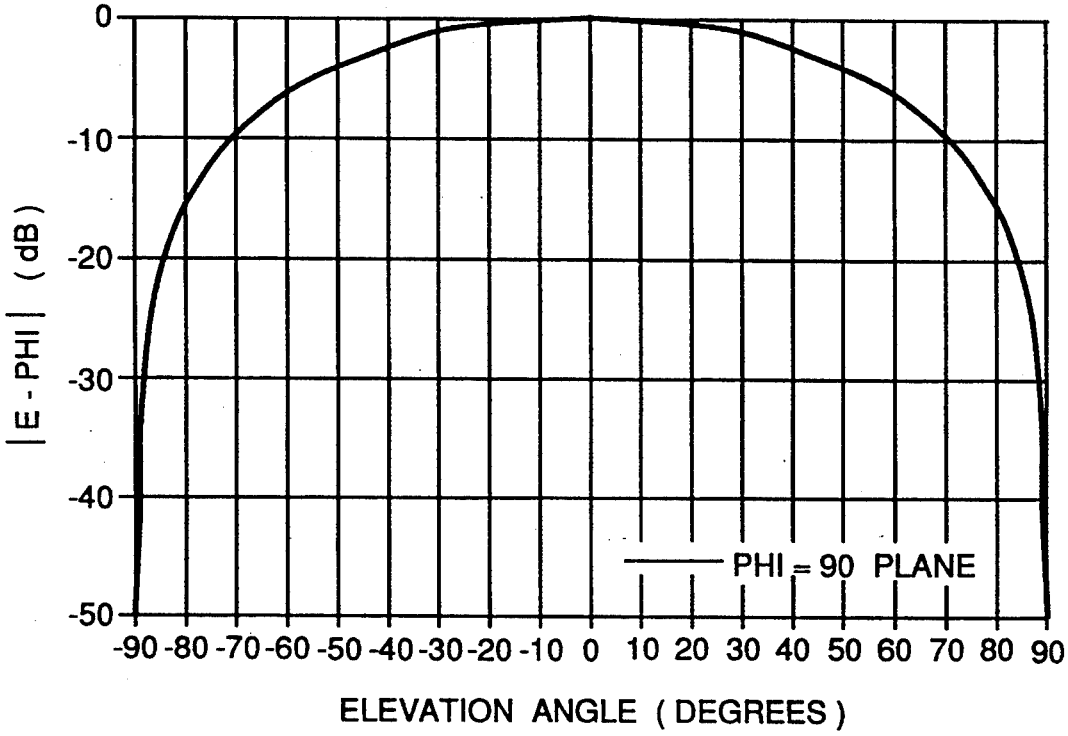
FIG. 6 illustrates the H-plane far-field radiation pattern of the present invention.

The length, d, FIG. 2, of the leaky wave strips 18 is chosen so that most of the energy in the waves leaks out. In this way, there is no energy reflected from the far ends of the leaky wave regions back into the patch. The solution for the input impedance and voltage at the edges is obtained by traditional transmission line circuit analysis with complex values used for the characteristic impedance and propagation constant. The radiation field is evaluated from an equivalent magnetic current distribution on the surface of the leaky wave region. Calculation of the equivalent magnetic currents is based on the tangential component of the electric field on the top surface of the leaky wave section. The solution for the leaky wave region fields outlined below provides a relation between the tangential E-field component and the vertical (perpendicular) E-field component. Vertical E-fields at the locations 'aa' and 'bb' (FIG. 3) are related to the voltages obtained by the transmission line model mentioned earlier. Thus for a given excitation at a feed point 24, FIG. 2, the equivalent magnetic current on the top surface of the antenna can be evaluated and used in computing the far zone radiation field. The far zone patterns for a typical case (substrate: relative dielectric constant=2.2, thickness=⅛ inch, 1 cm wide, and 1.58 cm long; leaky wave region: relative dielectric constant=10, thickness=1/64 in, 1 cm wide and 1.62 cm long; frequency of 5 GHz) are shown in FIGS. 5 and 6.

For fabrication of the microstrip patch antenna elements 10 of the present invention described herein, dielectric substrates 14 like quartz, alumina, or plastics like PTFE (Polytetra fluoro-ethylene) are used. The ground plane 12 at the bottom surface is usually copper (with a conducting adhesive thin film whenever needed). The conducting patch 16 on the top surface is fabricated by vacuum evaporation directly onto the substrate 14. The desired patch antenna dimensions are realized by a photoetching process similar to that used in printed circuit or semiconductor device technology. The overlaying dielectric material for the leaky wave region should have a higher dielectric constant than that of the lower substrate 14. Any dielectric material with low loss at microwave frequencies can be used for this purpose. These dielectric overlays 18 are glued onto the substrate 14 by low loss adhesives.

Figure 8A:
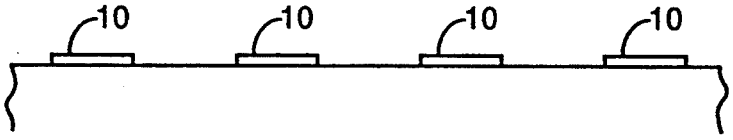
FIG. 8A and 8B illustrates antenna systems using the present invention.
Figure 8B:
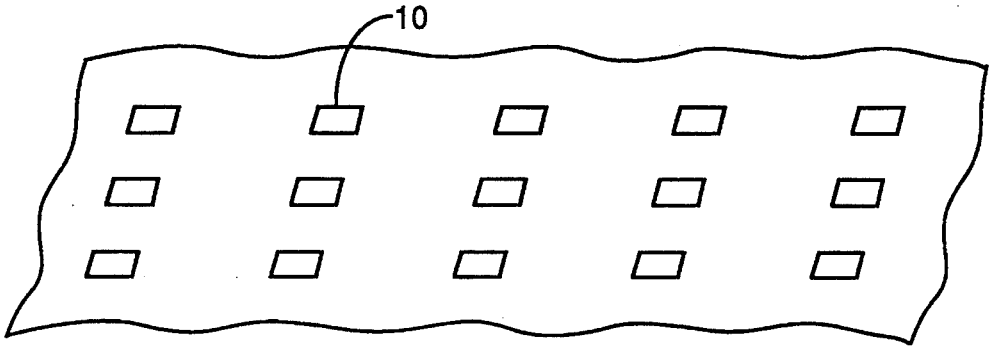

FIGS. 8A and 8B illustrate the antenna elements 10 placed in a one or two dimensional arrays to form an antenna system.

Figure 8C:
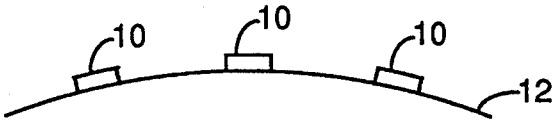
FIG. 8C illustrates the present invention mounted on a generic curved surface.

FIG. 8C illustrates placement on a curved surface.

Figure 9:
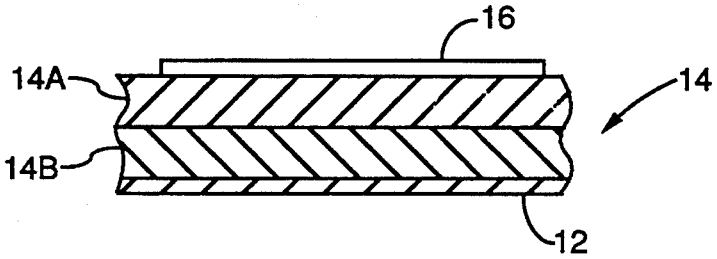
FIG. 9 illustrates the present invention having a substrate of multiple layers.
Figure 10:
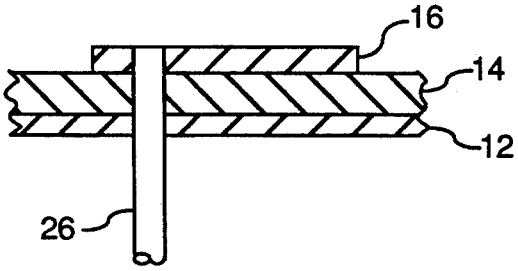
FIG. 10 illustrates a coaxial feed line to the patch of the present invention.

FIG. 9 illustrates a substrate 14 with two layers 14A and 14B. FIG. 10 illustrates a coaxial feed 26 to the patch 16 of element 10.

Figure 7:
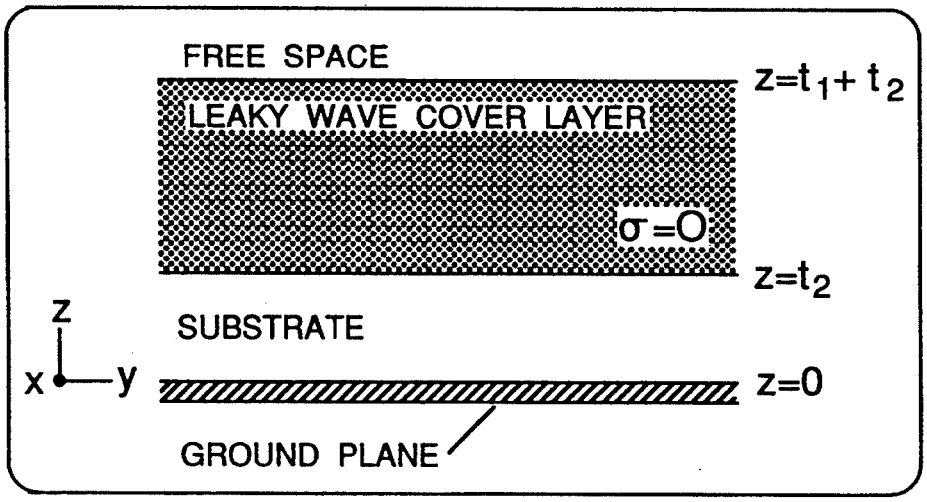
FIG. 7 illustrates a stratified media of the present invention.

The stratified media of infinite extent in the yz-plane as shown in FIG. 7 consists of a high permittivity dielectric above a grounded substrate of lower permittivity. The stratified media of infinite extent in the yz-plane as shown in FIG. 7 consists of a high permittivity dielectric above a grounded substrate of lower permittivity.

TM Helmholtz Wave Equation

The TM Helmholtz equation to be solved for the above structure is $$\left[\frac{d^2}{dx^2}+\omega^2\mu\epsilon+\gamma^2\right]H_y=0,$$

and the solution of this equation can be written as:

$$H_y=\begin{cases} C_1e^{-jh3x} & x\geqq t\\ C_3\cos(h_2x)+C_4\sin(h_2x) & 0\leqq x\leqq t\\ C_5\cos(h_1x)+C_6\sin(h_1x) & -b\leqq x\leqq 0\end{cases}$$

$$\text{and with } E_x=\frac{\gamma}{j\omega\epsilon}H_y,$$

$$E_x=\begin{cases} \frac{\gamma}{j\omega\epsilon_0}C_1e^{-jh3x} & x\geqq t\\ \frac{\gamma}{j\omega\epsilon_0}C_3\cos(h_2x)+\frac{\gamma}{j\omega\epsilon_0K}C_4\sin(h_2x) & 0\leqq x\leqq t\\ \frac{\gamma}{j\omega\epsilon_1}C_5\cos(h_1x)+\frac{h_2}{j\omega\epsilon_1}C_6\sin(h_1x) & -b\leqq x\leqq 0\end{cases}$$

$$\text{Also with } E_z=\frac{1}{j\omega\epsilon}\frac{\partial H_y}{\partial x},$$

$$E_z=\begin{cases} \frac{-h_3}{\omega\epsilon_0}C_1e^{-jh3x} & x\geqq t\\ \frac{-h_2}{j\omega\epsilon_0K}C_3\sin(h_2x)+\frac{h_2}{j\omega\epsilon_0K}C_4\cos(h_2x) & 0\leqq x\leqq t\\ \frac{-h_1}{j\omega\epsilon_1}C_5\sin(h_1x)+\frac{h_1}{j\omega\epsilon_1}C_6\cos(h_1x) & -b\leqq x\leqq 0\end{cases}$$

-continued where $$C_1 = -\frac{\epsilon_{r1}h_2\sin(h_2t) + h_1K\cos(h_2t)\tan(h_1b)}{jKh_3\epsilon_{r1}\tan(h_1b)e^{-jh3c}} C_6$$

$$C_3 = C_5 = \frac{-1}{\tan(h_1b)} C_6$$

$$C_4 = \frac{h_1K}{h_2\epsilon_{r1}} C_6$$

$$K = \epsilon_{r2} - \frac{j\sigma}{\omega\epsilon_0}$$

and $$h_1 = k_0\sqrt{\epsilon_{r1} + \gamma^2}$$

$$h_2 = k_0\sqrt{K + \gamma^2}$$

$$h_3 = k_0\sqrt{\epsilon_0 + \gamma^2}$$

Enforcing the continuity of the tangential E and H across the various boundaries leads to the TM characteristic transcendental equation.

$$E_{tan1}|_{x=-b-} = E_{tan1}|_{x=-b+}$$

$$E_{tan2}|_{x=-o-} = E_{tan2}|_{x=-o+}$$

$$E_{tan3}|_{x=-t-} = E_{tan3}|_{x=-t+}$$

$$H_{tan1}|_{x=-b-} = H_{tan1}|_{x=-b+}$$

$$H_{tan2}|_{x=-o-} = H_{tan2}|_{x=-o+}$$

$$H_{tan3}|_{x=-t-} = H_{tan3}|_{x=-t+}$$

TM CHARACTERISTIC EQUATION $$kh_1 \tan(h_1b)\,[jkh_3 \tan(h_2t)+h_2] + {}_{r1}h_2[-jkh_3+h_2 \tan(h_2t)]=0$$

The solution of this equation yields the longitudinal propagation constant which consists of the attenuation constant, $\alpha$, and the phase constant, $\beta$. With $\gamma$ from the above transcendental equation, we approximate the complex characteristic impedance of the leaky wave patch as:

$$z_o = \frac{E_x}{H_y}\ \frac{b}{W_c} = \frac{\gamma}{j\omega\epsilon_1}\ \frac{b}{W_c}$$

where $W_c$ is the effective width of the patch to which the leaky wave regions are appended.

Equivalent Magnetic Current for the Augmented Patch

The equivalent magnetic current is found by starting with the voltage distribution along z as shown below.

$$V(z) = \frac{\gamma}{j\omega\epsilon_1h_1}[C_6 - C_5\sin(h_1b) - C_6\cos(h_1b)]$$

But $$C_5 = \frac{-1}{\tan(h_1b)} C_6 \rightarrow V(z) = \frac{\gamma}{j\omega\epsilon_1h_1} C_6 \rightarrow C_6 = \frac{j\omega\epsilon_1h_1}{\gamma} V_{(z)}$$

In region 3, x≧t, so $$E_z = \frac{-h_3}{\omega\epsilon_0} C_1e^{-jh3x}$$

where $$C_1 = \text{Konst} * C_6 \rightarrow E_z(x = t^+) = \frac{-h_3}{\omega\epsilon_0}\text{Konst}\frac{j\omega\epsilon_1h_1}{\gamma} V(z)e^{-jh3t}$$

Substituting for Konst yields $$E_z(x = t^+) = \frac{h_1}{\gamma}\left[\frac{\epsilon_{r1}h_2\sin(h_2t) + h_1K\cos(h_2t)\tan(h_1b)}{K\tan(h_1b)}\right]V(z)$$

Finally, the magnetic current density M is then given by $$M(z) = \frac{h_1}{\gamma}\left[\frac{\epsilon_{r1}h_2\sin(h_2t) + h_1K\cos(h_2t)\tan(h_1b)}{K\tan(h_1b)}\right]V_oe^{-\gamma z}$$

Clearly, many modifications and variations of the present invention are possible in light of the above teachings and it is therefore understood, that within the inventive scope of the inventive concept, the invention may be practiced otherwise than specifically claimed.

What is claimed is:

1. An improved microstrip patch antenna element, a mounting surface having said improved microstrip patch antenna thereon, a means of feeding energy to said improved microstrip patch antenna, said improved microstrip patch antenna element comprising:

a ground plane, said ground plane mounted on said mounting surface, said ground plane being composed of a metallic material;

a substrate, said substrate mounted onto said ground plane, said substrate being a low-loss dielectric material, said substrate being at least one layer of material;

a patch, said patch being mounted on said substrate, said patch having a desired shape and thickness, said patch being composed of a metallic material, said patch having radiating edges thereon; and a plurality of leaky wave strips, said leaky wave strips being mounted on said substrate and adjacent to said patch and in contact with said radiating edges of said patch, said leaky wave strips having a desired width, thickness and length and composed of a dielectric material to maximize the bandwidth of a radiated energy, said dielectric material of such leaky wave strips having a dielectric constant greater than the dielectric constant of said substrate.

2. An improved microstrip patch antenna as defined in claim 1 wherein said ground plane is copper.

3. An improved microstrip patch antenna as defined in claim 1 wherein said substrate is selected from the group consisting of quartz, alumina and plastic.

4. An improved microstrip as defined in claim 1 wherein said patch is made of a metallic material such as copper or gold.

5. An improved microstrip patch antenna as defined in claim 1 wherein said patch is rectangular and said leaky wave strips are rectangular, the width of said leaky wave strips perpendicular to said edges of said patch being optimized to maximize the radiated energy to leak out.

6. An improved microstrip patch antenna as defined in claim 1 wherein said leaky wave strips overlay onto said edges of said patch.

7. An improved microstrip patch antenna as defined in claim 1 wherein said leaky wave strips cover said patch thereby creating two leaky wave regions.

8. An improved antenna on a system, said improved antenna systems comprising:

a plurality of improved microstrip patch antenna elements, each of said elements comprising:

a ground plane, said ground plane mounted on said mounting surface, said ground plane being composed of a metallic material;

a substrate, said substrate mounted onto said ground plane, said substrate being a low-loss dielectric material, said substrate being at least one layer of material;

a patch, said patch being mounted on said substrate, said patch having a desired shape and thickness, said patch being composed of a metallic material, said patch having radiating edges thereon; and a plurality of leaky wave strips, said leaky wave strips being mounted on said substrate and adjacent to said patch and in contact with said radiating edges of said patch, said leaky wave strips having a desired width, thickness and length and composed of a dielectric material to maximize the bandwidth of radiated energy, said dielectric material of such leaky wave strips having a dielectric constant greater than the dielectric constant of said substrate; and a plurality of feed means for each of said improved microstrip patch antenna elements.

9. An improved antenna system as defined in claim 8 wherein said elements are mounted in either a one dimensional or two dimensional array.

10. An improved antenna system as defined in claim 8 wherein said feeds means are selected from the group consisting of coaxial lines entering from underneath said substrate, microstrip lines, and an aperture feed in said ground plane.

* * * * *